United States Patent [19]

Carre et al.

[11] Patent Number: 4,588,363

[45] Date of Patent: May 13, 1986

[54] VOLUMETRIC SCREW COMPRESSOR

[75] Inventors: Jean-Jacques Carre, Le Raincy; Roland Levrai, Stains, both of France

[73] Assignee: Societe Anonyme D.B.A., Paris, France

[21] Appl. No.: 713,358

[22] Filed: Mar. 18, 1985

[30] Foreign Application Priority Data

Mar. 28, 1984 [FR] France ..... 84 04841

[51] Int. Cl.[4] ..... F01C 1/16; F01C 1/24

[52] U.S. Cl. ..... 418/201

[58] Field of Search ..... 418/201-206

[56] References Cited

U.S. PATENT DOCUMENTS

| | | | |
|---|---|---|---|
| 2,287,716 | 6/1942 | Whitfield . | |
| 2,410,172 | 10/1946 | Lysholm . | |
| 3,073,514 | 1/1963 | Bailey | 418/201 |
| 3,108,740 | 10/1963 | Schibbye | 418/201 |
| 3,414,189 | 12/1968 | Persson | 418/201 |
| 3,677,664 | 7/1972 | Wycliffe | 418/201 |
| 4,062,199 | 12/1977 | Kasahara | 418/201 |

FOREIGN PATENT DOCUMENTS

| | | |
|---|---|---|
| 1949175 | 4/1971 | Fed. Rep. of Germany . |
| 325597 | 11/1957 | Switzerland . |
| 959833 | 6/1964 | United Kingdom . |

*Primary Examiner*—Leonard E. Smith
*Assistant Examiner*—Jane E. Obee
*Attorney, Agent, or Firm*—Larry J. Palguta; Ken C. Decker

[57] ABSTRACT

The compressor incorporates a front inlet aperture consisting of two annular sectors (11, 12) each having an opening angle of less than 200 degrees, the two annular sectors being essentially symmetrical relative to the plane of intersection of the rotor chambers and seperated from one another by a central portion of an end wall of the casing defining the said annular sectors. The outlet opening (16) is formed in a peripheral wall of the casing and has a general V-shape whose convergent edges are parallel, in projection, to the threads of the respective rotors and whose axial height is less than twice the axial distance between two adjacent rotor threads.

11 Claims, 3 Drawing Figures

VOLUMETRIC SCREW COMPRESSOR

The present invention concerns screw compressors, and in particular volumetric compressors or blowers intended for the supercharging or scavenging of heat engines for motor vehicles.

The present invention concerns more specifically screw compressors with front entry, of the type incorporating a male rotor and a female rotor which cooperate, situated respectively in a pair of intercommunicating parallel cylindrical chambers formed in a casing, an inlet passage communicating with one end of the pair of chambers through an inlet opening defined, at this end of the pair of chambers, by a wall partially obstructing the adjacent portions of each chamber, and an outlet passage communicating with the other end of this pair of chambers.

A compressor of this type is described in the document FR-A-1,216,086. In the compressor described in the said document, in which the rotors are mounted so as to overhang at one end of the casing and the female rotor is driven by contact with the male rotor, the inlet opening consists of the other frontal open end of the casing and is partially obstructed by a cover plate of small dimensions obstructing the zone of interpenetration of two grooves each belonging to one of the rotors so as to prevent direct communication between the inlet opening and the outlet opening, which covers axially more than half the length of the rotors and partially covers radially the opposite end portions of the rotors from the inlet opening.

The aim of the present invention is to propose improvements to this type of compressor and to propose a novel arrangement of inlet and outlet openings for the construction of a volumetric compressor which is compact, which has a low inertia, a high rotational speed and high output, by arranging permanently, in each rotor, a groove acting as a plug between the inlet and outlet openings, along which an intermediate pressure exists graduating between atmospheric pressure at the inlet and the excess delivery pressure at the exhaust.

To achieve this, according to a characteristic of the invention, the inlet opening consists, for each chamber, of an annular sector with an opening angle of less than 200°, the two annular sectors being essentially symmetrical relative to the plane of intersection of the chambers and separated from one another by a central portion of the wall.

According to another characteristic of the invention, the outlet passage communicates with the chambers through an outlet opening formed in a peripheral wall of the casing, this outlet opening having a general V-shape whose center lies essentially in the plane of intersection of the chambers and whose edges which converge towards one another are essentially parallel, in projection, to the threads of the respective rotors.

Other characteristics and advantages of the present invention will emerge from the following description of an embodiment, which is given by way of illustration and is not in any way limiting, with reference to the accompanying drawings, in which.

Figure 1:
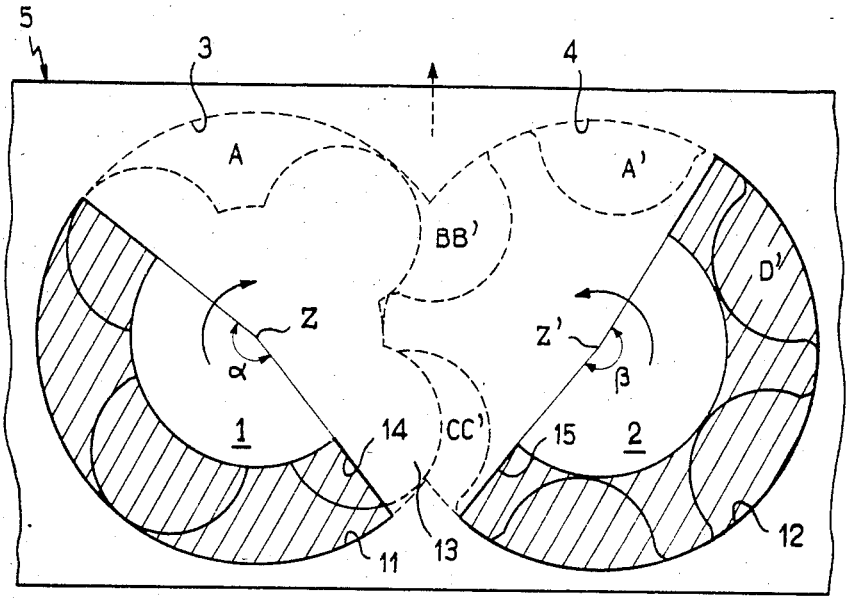
FIG. 1 is a front view of a compressor according to the invention, showing the relative arrangement of the annular sections forming the opening for the admission of air.

As shown in the figures, the screw compressor according to the invention incorporates a male rotor (1) and a female rotor (2) each incorporating helical threads arranged in such a way that the threads of each rotor cooperate with those of the other rotor in light mutual contact, in a pair of parallel cylindrical chambers (3) and (4), respectively, intercommunicating longitudinally along a plane of intersection which is parallel to the axes Z and Z' which are common, firstly, to the male motor (1) and the chamber (3), and secondly, to the female rotor (2) and the chamber (4). The rotors (1) and (2) are coupled at one end, in the example shown, to a pair of gear wheels (6) and (7) cooperating mutually without play so as to drive the rotors (1) and (2) in synchronism. The gear wheels (6) and (7) are situated in an internal cavity of the casing (5) separated so as to be sealed from the chambers (3) and (4) by a frontal bulkhead in which the rotors (1) and (2) are supported so as to pivot, the latter incorporating, at their opposite ends from the gear wheels (6) and (7), bearings, supported in a front end wall (8) attached to the casing (5). Preferably, the shaft (9) of the gear wheel (7) and of the female rotor (2) is coupled to a device for driving the compressor, the gear wheel (7) of the female rotor (2) then being the driving gear wheel of the gear wheel (6) of the male rotor (1), according to a general arrangement forming the subject of the document EP-0,101,345 whose contents is assumed attached herewith for reference.

In accordance with a feature of the invention, two cutouts are formed in the front end wall (8) in the shape of annular sectors (11) and (12) forming the inlet opening of the compressor. Each annular sector (11) or (12) has an external profile whose center lies on the corresponding axis Z or Z' and whose radius corresponds to that of the associated chamber (3) or (4), and an internal profile in the shape of an arc of a circle, whose center also lies on the corresponding axis Z or Z' and whose radius corresponds to the radius of the hub of the corresponding rotor (1) or (2). Advantageously, the male rotor incorporates four lobes or threads and the female rotor incorporates six threads, the threads having a symmetrical profile or a profile which is slightly asymmetrical. As shown in FIG. 1, the two sectors (11) and (12) are essentially symmetrical relative to the plane of intersection of the chambers (3) and (4) and are separated, in the region of their zones which are closest to one another, by a central portion (13) of the wall (8). The adjacent edges (14) and (15) of the sectors (11) and (12) extend radially towards the respective axes Z and Z', forming between them an angle of less than 90°, typically in the region of 80°. The annular sector (11) of the male screw has an opening angle $\alpha$ of less than 180°, typically in the region of 165°. However, the annular sector (12) of the female screw (2) has an opening angle $\beta$ which is greater than 180° but is less than 200°, typically in the region of 190°.

Figure 2:
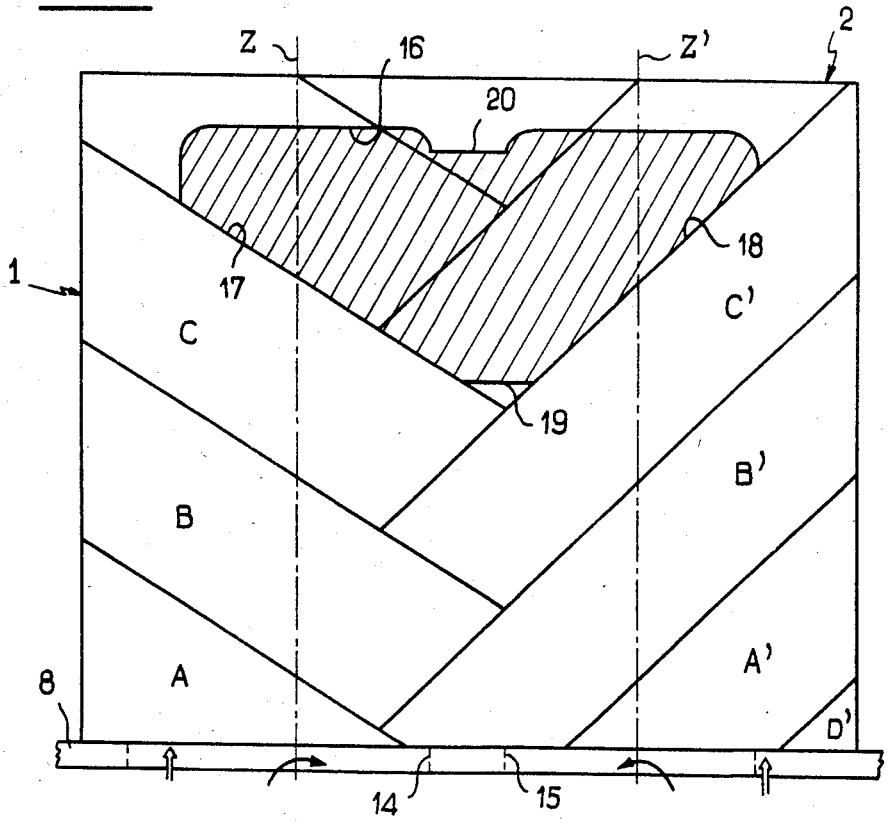
FIG. 2 is a diagrammatic plan view of the compressor shown in FIG. 1 showing the arrangement of the outlet opening.
Figure 3:
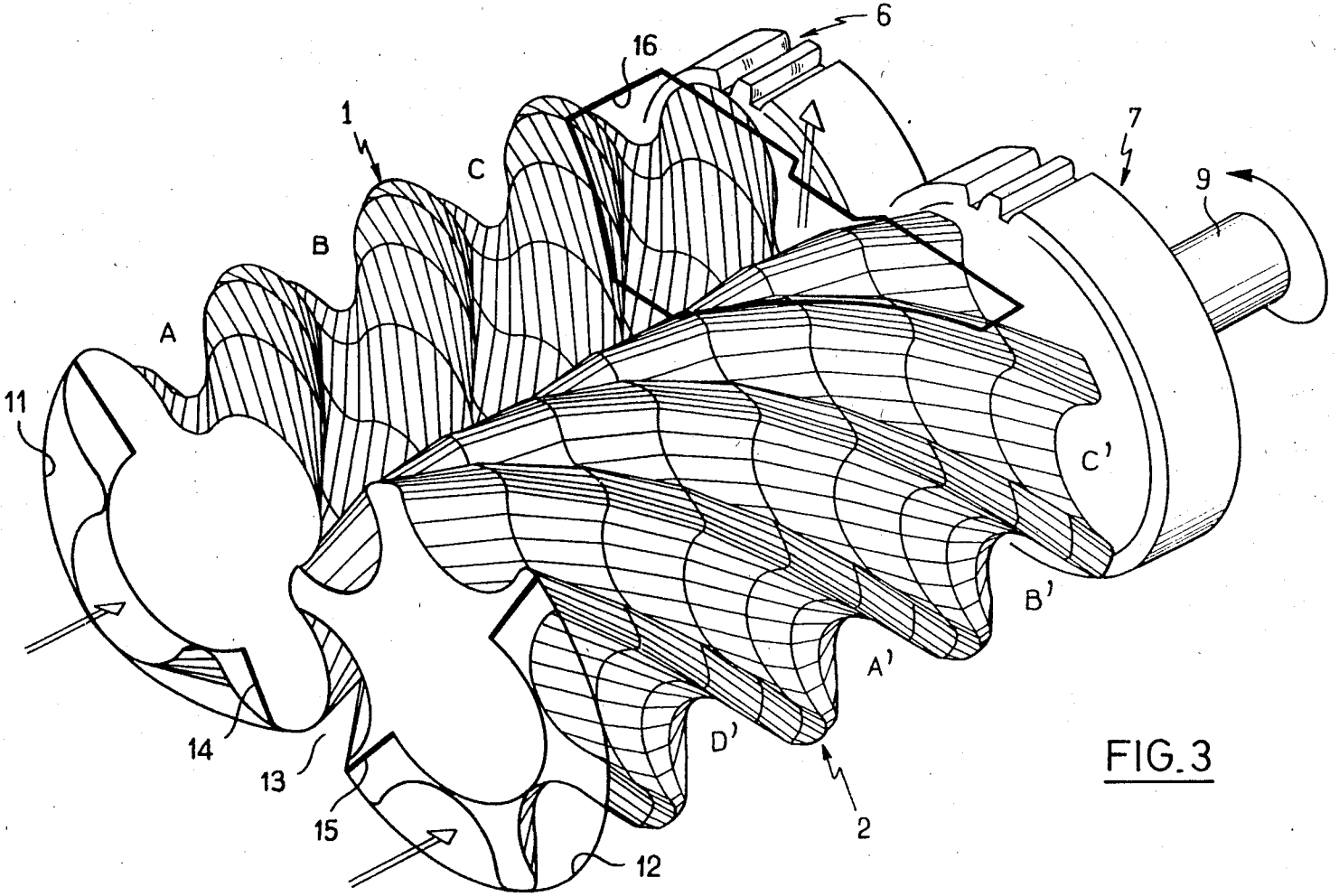
FIG. 3 is a diagrammatic view in perspective of the compressor shown in FIGS. 1 and 2.

As shown in FIGS. 2 and 3, a V-shaped outlet opening (16) is formed in a lateral wall of the casing (5) which is opposite, relative to the plane of the axes Z and Z', to the central separating portion (13) of the wall (8), the outlet opening (16) having a general profile which is essentially triangular with a base perpendicular to the axes Z and Z', at a small distance from the opposite end of the rotors (1) and (2) from the wall (8), and convergent edges (17) and (18), lying in projection in a plane which is parallel to the plane of the axes Z and Z', essentially parallel to the threads of the respective rotors (1) and (2), as shown clearly in FIG. 2. Preferably, the apex of the triangle is truncated, the outlet opening (16) consequently having a small transverse edge (19) opposite the base and parallel to the latter. Similarly, the base has a central projecting portion (20) extending transversely, corresponding essentially to that of the small edge (19). As shown in FIG. 2, the center of the outlet opening (16) is essentially situated in the plane of intersection of the chambers (3) and (4) but is slightly asymmetrical in order to take account of the different number of threads on the male (1) and female (2) rotors. In accordance with a feature of the invention, the maximum axial height of the opening (16) (between its large base and the small edge (19)) is less than twice the axial distance between two adjacent rotor threads, typically of the order of 1.25 times the axial distance between adjacent rotor threads. In the example shown in FIG. 3, it will be noted that the overall length of the rotors corresponds essentially to one half of the pitch of the threads of each rotor.

With the arrangement described above, and referring to the configuration shown in the drawings, it will be noted, taking account of the directions of rotation shown by the arrows, that the groove B of the male screw (1) and the groove B' of the female screw (22) enter into communication or interpenetration with one another, being isolated at their inlet end, from the inlet openings (11) and (12). The same applies to the grooves C and C' which, however, in the position shown are about to cease to coincide in order to enter into communication with the corresponding inlet openings (11) and (12). In addition the groove A which is also obstructed by the wall (8) is in communication with the groove D' of the female screw (2) which communicates with the inlet opening (12). On the other hand, the groove A', in the configuration shown, is completely closed. It will thus be understood that the grooves B and B' remain closed for a half rotation of each rotor, these grooves thus serving the function of grooves which act as plugs between the inlet (11, 12) and the exhaust (16), the pressure of the air in these grooves B and B' increasing from a value equal to atmospheric pressure to a nominal compression pressure, of the order of 1.6 bar absolute, at the boundary of the exhaust. Perfect isolation is thus achieved between the inlet and the exhaust in a particularly compact arrangement with a large pitch, owing to the grooves acting as plugs in which the pressure gradually increases as rotation progresses, up to the nominal compression pressure, at the boundary of the exhaust, thus providing a delivery pressure which is essentially constant and whose fluctuations are greatly attenuated.

Although the present invention is described above in relation to particular embodiments, it is not limited by them but on the contrary is capable of modifications and variants which will be apparent to a person versed in the art.

We claim:

1. A screw compressor, which comprises, in a casing having a peripheral wall and opposite end walls, a male rotor and a female rotor rotating around parallel axes in intercommunicating rotor chambers, inlet passage means formed in a first of said opposite end walls, and an outlet passage adjacent a second of said opposite end walls, wherein said inlet passage means consists of two separate annular sectors disposed apart from one another and centered respectively on said axes, the annular sectors each having an opening angle of less than 200° and being substantially symmetrical relative to a plane of intersection of said rotor chambers, and each annular sector having an adjacent radial edge separated from the other adjacent radial edge by a central portion of said first end wall.

2. The compressor according to claim 1, wherein said adjacent radial edges of said annular sectors form between them an angle of approximately 80°.

3. The compressor according to claim 1, wherein said outlet passage consists of an outlet opening formed in said pheripheral wall of said casing and having a general V-shape substantially centered on said plane of intersection of said chambers and having convergent edges converging toward said first end wall and parallel, in projection, to threads of the respective said rotors.

4. The compressor according to claim 3, wherein the V-shape of the outlet opening has a base edge extending at a distance from said second end wall.

5. The compressor according to claim 3, wherein the V-shape of said outlet opening has an axial height less than twice the axial distance between two adjacent rotor threads.

6. The compressor according to claim 5, wherein said axial height of the V-shape of said outlet opening is substantially equal to 1.25 times the axial distance between two adjacent rotor threads.

7. The compressor according to claim 3, further comprising, adjacent said second end wall, at least one pair of gear wheels for driving said rotors in synchronism.

8. The compressor according to claim 7, wherein said male rotor has four threads and said female rotor has six threads.

9. The compressor according to claim 8, wherein the annular sector for the male rotor has an opening angle of less than 180°.

10. The compressor according to claim 7, wherein the annular sector for the female rotor has an opening angle greater than 180°.

11. A screw compressor, which comprises, in a casing having a peripheral wall and oppositely disposed end walls, a male rotor and a female rotor rotating around parallel axes in intercommunicating rotor chambers, inlet passage means formed in a first of said oppositely disposed end walls, and an outlet passage disposed in said peripheral wall, wherein said inlet passage means comprises two separate annular sectors disposed apart from one another and centered respectively on said axes, the annular sectors each having an opening angle of less than 200° and being substantially symmetrical relative to a plane of intersection of said rotor chambers, each annular sector having a radial edge adjacent and separated from the other radial edge by a central portion of said first end wall, and said radial edges of said annular sectors forming between them an angle of approximately 80°, the compressor providing through said outlet passage a medium at substantially constant pressure.

* * * * *